United States Patent [19]

Plumadore

[11] 4,167,325

[45] Sep. 11, 1979

[54] ELECTROGRAPHIC RECORDING APPARATUS

[75] Inventor: John D. Plumadore, Westfield, Mass.

[73] Assignee: James River Graphics Inc., So. Hadley, Mass.

[21] Appl. No.: 848,995

[22] Filed: Nov. 7, 1977

[51] Int. Cl.[2] ..... G03G 15/00

[52] U.S. Cl. ..... 355/14; 355/3 CH; 361/229; 361/235

[58] Field of Search ..... 355/3 R, 3 CH, 14; 361/229, 235

[56] References Cited

U.S. PATENT DOCUMENTS

| | | | |
|---|---|---|---|
| 3,678,350 | 7/1972 | Matsumoto et al. | 361/229 |
| 3,779,749 | 12/1973 | Sato | 361/229 X |
| 3,784,299 | 1/1974 | Manghirmalani | 355/3 R |
| 3,787,706 | 1/1974 | DeGeest | 355/3 CH X |
| 3,967,891 | 7/1976 | Rippstein | 355/3 CH |

*Primary Examiner*—Fred L. Braun

*Attorney, Agent, or Firm*—Joseph H. Yamaoka; John W. Kane, Jr.

[57] ABSTRACT

An improved electrographic recording system. The system includes a first charging corona for providing a distribution of charge on a surface of a recording medium representing a desired image to be recorded on the medium. The system also includes an automatically controlled second charging corona. A sensor continuously monitors the potential of a conductive layer of the medium and automatically controls the magnitude of the charge deposited by the second charging corona so as to maintain a constant potential at the conductive layer of the medium.

8 Claims, 3 Drawing Figures

ELECTROGRAPHIC RECORDING APPARATUS

The Government has rights in this invention pursuant to Contract Number F33615-75C-1312, awarded by the United States Air Force AFSC Aeronautical Systems Division.

BACKGROUND OF THE INVENTION

This invention relates to an apparatus for recording images on an electrographic medium and in particular to an electrophotographic recording system that employs two corona elements that deposit charge on a photoconductive surface of the electrophotographic medium. The polarity of the charge deposited by the second corona element is opposite to that of the charge deposited by the first corona element and the second corona element is automatically controlled to maintain a conductive layer of the recording medium at a constant potential.

In one type of electrophotographic recording process, the recording medium is a film having a polyester base, a transparent conductive layer that overlies the polyester base and a photoconductive layer that overlies the transparent conductive layer. To record on the film, a uniform electrostatic charge is first applied, by means of a charging corona element, to the surface of the photoconductive layer of the film. The uniform charge is then selectively dissipated by exposing the surface to a light image of the pattern to be recorded. The resulting pattern of charges is an electrostatic latent image on the photoconductive surface which can then be rendered visible for example, in an attraction toning process, by applying thereto electrostatically charged developer particles which are held to the surface of the photoconductive layer by means of the electrostatic force developed between the developer particles and the charge on the photoconductive surface. A permanent visible image can be obtained, for example, by using developer particles which can be heat fused to the photoconductive layer, and then subjecting the visible image to a heat fusing step.

During the recording process it is desirable to maintain the transparent conductive layer of the film at a constant potential. This was initially accomplished in prior art recording systems by providing an electrical contact to the transparent conductive layer and then connecting the electrical contact to ground in the recording system. Because the transparent conductive layer is very thin, typically on the order of 0.01 micrometers, and because the transparent conductive layer is sandwiched between the polyester base and the photoconductive layer, it is very difficult to provide a good, reliable electrical connection to the transparent conductive layer. It would, therefore, be desirable to provide a recording system in which the transparent conductive layer is maintained at ground potential without making electrical contact to that layer of the film. U.S. Pat. No. 3,779,749—Sato eliminates the need to provide an electrical contact to the transparent conductive layer of the film. In the Sato patent, a second corona element, located after the development stage of the recording apparatus, deposits a charge of the opposite polarity of the charge deposited by the charging corona element onto the photoconductive surface of the film. The voltage applied to each corona element is manually adjusted so that the magnitude of both corona currents are equal. Thus, the amount of positive charge deposited on the photoconductive surface by one corona element is, in theory, balanced out by the amount of negative charge deposited on the photoconductive surface by the other corona element. Since the voltage of the conductive layer is determined by the magnitude of the net charge on the photoconductive layer, if the net charge is zero, then the conductive layer will be at ground potential.

One disadvantage of the recording system described in the Sato patent is that even though a constant voltage is applied to a corona element, the magnitude of the corona current and, therefore, the charge deposited on the photoconductive surface will undergo considerable variation depending upon the environmental conditions. Thus, temperature, relative humidity, chemical composition of the environment, and particularly barometric pressure will all affect the corona current level. It is also well known that environmental conditions do not affect both positive and negative corona elements to the same degree. Thus, as the environmental conditions change from those that existed when the voltage applied to the two corona elements were intially adjusted, the two corona elements will tend to put a net charge of one polarity or the other on the photoconductive surface of the film.

Another disadvantage of the recording system described in the Sato patent is that the system does not continually compensate for other sources of charge variation inherent in the recording process. For example, since the recording process includes an exposure step wherein charge deposited on the electrophotographic surface of the medium is selectively dissipated, different recorded images will generally cause different amounts of charge to remain on the photoconductive surface of the medium. Also, since the toner particles employed in the development step are themselves charged particles, they will also have an affect on the net charge on the photoconductive layer of the medium. Given the above sources of charge variation it can be appreciated that even though two manually adjustable corona elements are provided, a significant variation in the net charge on the surface of the photoconductive layer can occur which will result in a variation of the potential of the conductive layer of the recording medium.

It is, therefore, the primary object of this invention to provide an improved apparatus for recording on an electrographic medium that reduces the variation of the potential of a conductive layer of the recording medium.

It is another object of this invention to provide an improved apparatus for recording on an electrographic medium that maintains a conductive layer of the medium at a constant potential despite variations in the net charge on the surface of the recording medium that result from recording different images on the medium or from applying charged toner particles to the medium.

It is another object of this invention to provide an apparatus for recording on electrophotograhic film that includes a charging corona element and a discharging corona element wherein the current level of the discharge corona element varies as a function of the magnitude of the voltage on a conductive layer of the electrophotographic film.

And yet another object of this invention is to provide a system for recording on electrophotographic film that includes a charging corona element and a discharging corona element wherein the discharging corona element is automatically controlled in order to maintain the conductive layer of the film at a constant potential even though environmental conditions affect the voltage versus current relationship of the corona elements.

SUMMARY OF THE INVENTION

In accordance with this invention, there is provided an improved electrographic recording system that includes means for providing a distribution of charge on a surface of the medium representing a desired image to be recorded on the medium. The recording system also includes an automatically controlled discharge corona element. A sensor continuously monitors the potential of a conductive layer of the medium. The sensor output signal automatically controls the magnitude of the charge deposited by the discharge corona element so as to maintain a constant potential at the conductive layer of the medium. The sensor output signal could if desired, also control the polarity of the charge deposited by the discharge corona element.

DESCRIPTION OF THE DRAWINGS

While the specification concludes with claims particularly pointing out and distinctly claiming that which is regarded as the present invention, the objects and advantages of this invention can be more readily ascertained from the following description of a preferred embodiment when read in conjunction with the accompanying drawings in which:

DETAILED DESCRIPTION

Figure 3:
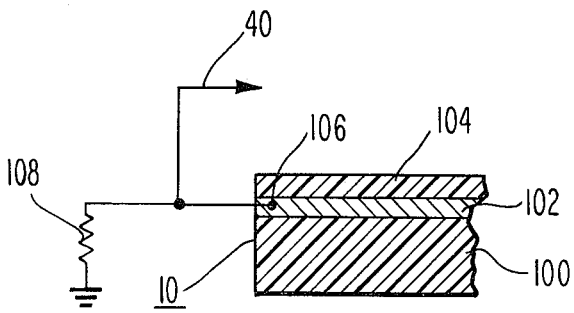
FIG. 3 is a schematic representation of the structure of one type of electrophotographic film used in the improved recording apparatus of this invention.

The improved recording system of this invention is particularly useful when recording on a strip of electrophotographic film having a three-layered structure as illustrated in FIG. 3. The first layer 100 of electrophotographic film 10 is a polyester base 100, about 125 micrometers thick, that forms an insulative substrate for the film 10. Overlying the polyester base 100 is a second, transparent conductive layer 102 about 0.01 micrometers thick. The film structure is completed by a photoconductive film matrix 104, about 9 micrometers thick, that overlies the transparent conductive layer 102.

Figure 1:
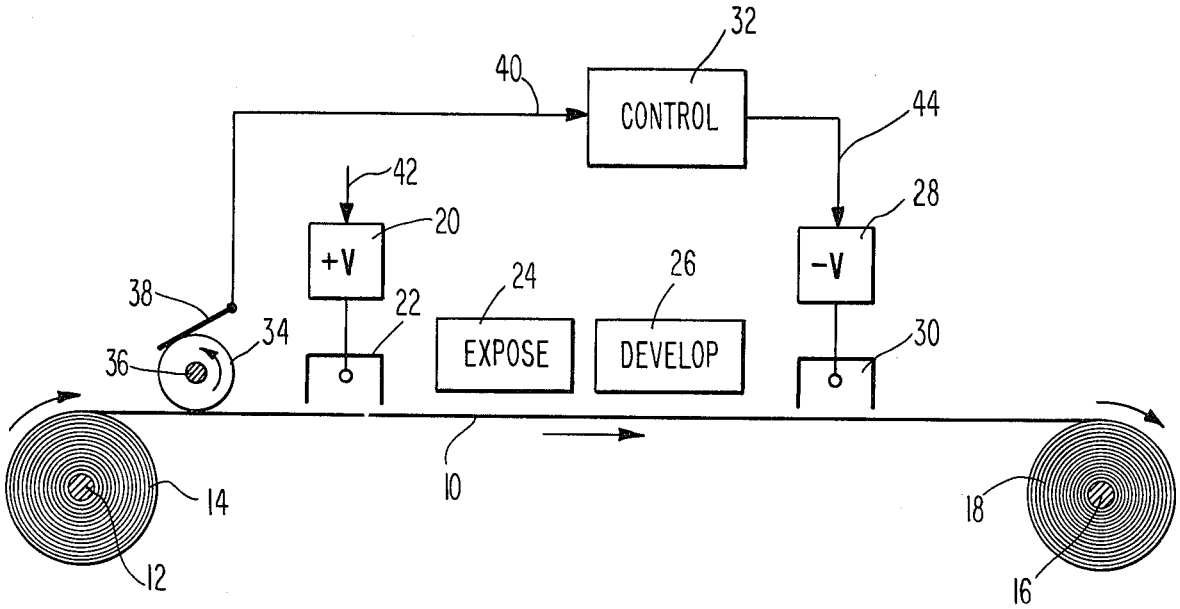
FIG. 1 is a general block diagram of a system for recording on electrophotographic film.

For the sake of convenience, an element depicted in more than one figure will retain the same element number in each figure. Referring now to FIG. 1, there is shown a general and partial block diagram of an electrophotographic film recording system. Since such recording systems are well-known in the art, only those elements of a recording system necessary to describe my invention have been illustrated. In FIG. 1 electrophotographic film 10 is being transported by conventional means, not shown, from a supply roll 14 mounted on shaft 12 to a take-up roll 18 mounted on shaft 16. In accordance with conventional techniques for recording on electrophotographic film 10, a corona charging unit 22 deposits a uniform distribution of charge on the photoconductive layer 104 of the electrophotographic film 10. A conventional high voltage power supply 20 energizes the corona charging unit 22. The level of deposited charge can be adjusted by varying the voltage output of power supply 20 as indicated by input signal line 42. The uniformly charged film 10 is then transported past an exposure station 24. At the exposure station 24, in accordance with well-known techniques, the charged surface of photoconductive layer 104 is subjected to a light pattern that corresponds to the desired image to be recorded on the film 10. Those areas of the photoconductive layer 104 that are exposed to the light become conductive and the charge originally deposited on those exposed areas of the photoconductive layer 104 will be dissipated. Those areas of the charged photoconductive layer 104 that are not exposed to light will retain a charge thereon. Thus, it can be seen that the combination of corona charging unit 22, high voltage power supply 20 and exposure unit 24 is a means for providing a distribution of charge on the surface of photoconductive layer 104, the distribution of the charge representing a desired image to be recorded on the electrophotographic film 10.

At this stage of the recording process, the distribution of charge representing the desired image to be recorded is referred to as an electrostatic latent image since it is not visible to the naked eye. In order to provide a visible image, the exposed electrophotographic film 10 is transported past a conventional development unit 26 that subjects the exposed film to charged toner particles which are, in an attraction toning process, attracted to the charged areas of the film. The developed film is then transported past a discharge corona unit 30 which is energized by a high voltage power supply 28 that is similar to power supply 20. The level of charge distributed by discharge corona unit 30 is automatically controlled by a signal, generated by control unit 32, that is applied to the input 44 of power supply 28. The input 40 of control unit 32 is connected to a brush 38 which contacts a sensor 34 that rotates on a shaft 36. Sensor 34 contacts the surface of photoconductive layer 104 of electrophotographic film 10 and is capacitively coupled to conductive layer 102 thereby providing a signal that represents the potential of the conductive layer 102.

The purpose of discharge corona unit 30, power supply 28 and control unit 32 is to maintain the conductive layer 102 at a constant potential which in a preferred embodiment is ground potential. Since the potential of conductive layer 102 is determined by the net charge existing on photoconductive layer 104 of the film, the potential of conductive layer 102 can be controlled by using the sensor output signal appearing at line 40 to cause discharge corona element 30 to deposit a charge on photoconductive layer 104 that will tend to reduce the net charge on photoconductive layer 104. In a preferred embodiment of the invention, the charging corona unit 22 deposits a uniform charge of one polarity on the photoconductive layer 104 while the discharge corona unit 30 deposits charge of a polarity opposite to the polarity of the charge deposited by charging corona unit 22. An embodiment is also contemplated wherein corona discharge unit 30 can deposit both negative and positive charge on photoconductive layer 104.

Figure 2:
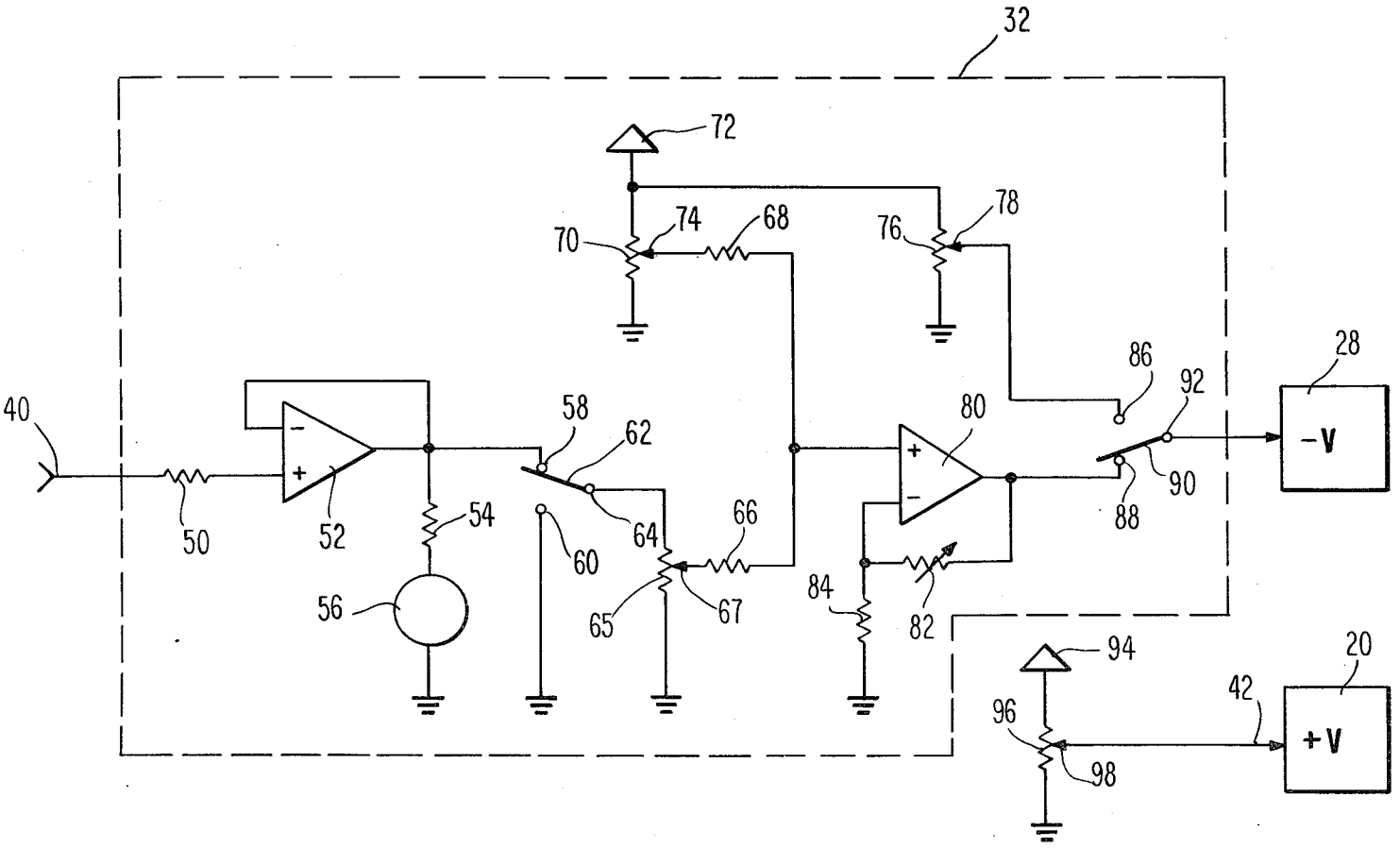
FIG. 2 is a schematic diagram of the control circuit, shown as a single block in FIG. 1, for controlling the discharge corona element.

FIG. 2 is a simplified schematic diagram of the control unit 32 illustrated as a single block in FIG. 1. The signal representing the potential on the conductive layer 102 of the electrophotographic film 10 is applied to the non-inverting input of amplifier 52 through an input resistor 50. The output of amplifier 52 is connected to the inverting input of amplifier 52 and also drives a meter 56 through a resistor 54. The output of amplifier 52 is also applied to one contact 58 of a two-position switch 62. The other contact 60 of the two-position switch is connected to ground. The signal appearing at the pole 64 of two-position switch 62 is applied across a potentiometer 65. The signal appearing at the arm 67 of potentiometer 65 is applied to the non-inverting input of amplifier 80 through input resistor 66. A voltage source 72 is connected across potentiometer 70. The voltage appearing at the arm 74 of potentiometer 70 is applied to the noninverting input of amplifier 80 through input resistor 68. The output of amplifier 80 is connected to the inverting input of amplifier 80 through variable resistor 82. The inverting input of amplifier 80 is also connected to ground through resistor 84. The output of amplifier 80 is connected to one contact 88 of two-position switch 90. The voltage source 72 is also applied across potentiometer 76. The voltage appearing at the arm 78 of potentiometer 76 is applied to the other contact 86 of two-position switch 90. The signal appearing at the pole 92 of two-position switch 90 is connected to input 44 of power supply 28 to provide control of discharge corona unit 30. Also shown in FIG. 2 is a voltage source 94 applied across potentiometer 96. The voltage appearing at the arm 98 of potentiometer 96 is applied to input 42 of power supply 20 to provide manual control of the charging corona unit 22.

A general description of the operation of the corona control circuits of FIG. 2 is now provided. The voltage at the arm 98 of potentiometer 96 is applied to the input 42 of power supply 20. Thus, potentiometer 96 is a means for manually adjusting the voltage output of power supply 20 which, in turn, determines the level of charge deposited by charging corona unit 22 on the surface of photoconductive layer 104 of electrophotographic film 10. When switch 90 is in the position to connect the pole 92 to contact 86, power supply 28 which determines the level of charge deposited by corona unit 30 on the surface photoconductive layer 104 is controlled solely by the voltage appearing at arm 78 of potentiometer 76. Under these operating conditions, the level of charge deposited on the surface of photoconductive layer 104 by both the charging corona unit 22 and the discharging corona unit 30 are subject only to manual adjustment.

When switch 90 is in the position to connect the pole 92 to contact 88, power supply 28 for the discharge corona unit 30 is subject to automatic and continuous adjustment as determined by the signal appearing at the input 40 of control circuit 32. In this automatic mode of operation, the signal representing the potential of the conductive layer 102 is applied at the input 40 of control circuit 32. Amplifier 52 acts as a high impedance buffer amplifier for the signal appearing at the input 40. The output of amplifier 52 drives a meter 56 in order to provide a visual indication of the polarity and magnitude of the potential of the conductive layer 102. The output of amplifier 52 is also applied across potentiometer 65 which provides some control of the magnitude of the signal applied to input resistor 66 of amplifier 80. Since the signal appearing at the arm 67 of potentiometer 65 and the signal appearing at the arm 74 of potentiometer 70 are applied, through input resistors 66 and 68 respectively, to the non-inverting input of amplifier 80, amplifier 80 acts as a summing amplifier. Thus, the d-c level of the output of amplifier 80 is determined by the constant voltage appearing at arm 74 of potentiometer 70 and the variation of the output of amplifier 80 is determined by the variation of the potential of the conductive layer 102 as provided by the signal at the arm 67 of potentiometer 65. To illustrate how control circuit 32 acts to maintain the conductive layer 102 at a constant potential, such as ground potential, consider a recording system in which the charging corona unit 22 deposits a uniform positive charge on the surface of photoconductive layer 104 and the discharging corona unit 30 deposits a negative charge on the surface of photoconductive layer 104. The magnitude of the signal appearing at the output of amplifier 80 varies in some proportion, as determined by the setting of potentiometer 65 and the gain of amplifiers 52 and 80, to the magnitude of the potential of the conductive layer 102. Since the voltage applied to the discharge corona unit 30 is also proportional to the voltage appearing at the output of amplifier 80, the amount of negative charge deposited on the surface of photoconductive layer 104 by discharge corona unit 30 will be in some direct proportion to the magnitude of the voltage appearing at the output of amplifier 80. Thus, if a relatively large positive potential exists at conductive layer 102, a large quantity of negative charge will be deposited on the surface of photoconductive layer 104, but if a relatively small positive potential exists at conductive layer 102 a much smaller quantity of negative charge will be deposited on the surface of photoconductive layer 104 by discharge corona unit 30.

In order to calibrate the automatic portion of control circuit 32, switch 62 is thrown into the position wherein the pole 64 is connected to ground through the contact 60. By adjusting the arm 98 of potentiometer 96, the operator can establish a desired uniform level of charge deposited by charging corona unit 22. Since there is zero volts being applied to the summing junction of amplifier 80 through resistor 66, the output of amplifier 80 is determined entirely by the adjustment of arm 74 of potentiometer 70. During calibration the operator adjusts potentiometer 70 so that a relatively small potential exists at the conductive layer 102 as indicated by meter 56. The operator would then throw switch 62 into the position wherein the pole 64 is connected to contact 58 so that the potential of conductive layer 102 now automatically controls the current level of discharge corona unit 30 in such a manner that the conductive layer 102 of electrophotographic film 10 is maintained very nearly at ground potential.

Although the selection of the range of the control potentiometers and the gain of the amplifiers in FIG. 2 can be readily selected by one skilled in the circuit design art, an embodiment of the control circuit depicted in FIG. 2 has been constructed in which the gain of amplifier 52 is fixed at +1, potentiometers 65 and 70 are 5,000 ohms, potentiometers 76 and 96 are 2,000 ohms, resistors 66 and 68 are both 10,000 ohms and resistor 82 is variable between 10,000 and 110,000 ohms.

It will be clear to those skilled in the art that whereas a preferred embodiment has been described wherein the charging corona unit 22 deposits a uniform positive charge on the surface of photoconductive layer 104 and the discharge corona unit 30 deposits a varying negative charge on the surface of photoconductive layer 104, the charging corona unit 22 could deposit a negative charge and the discharge corona unit 30 could deposit a positive charge. It will also be understood by those skilled in the art that the discharge corona unit 30 might include the capability of depositing both a negative charge and a positive charge on the surface of photoconductive layer 104 depending on the polarity of the potential of conductive layer 102. Thus, if the sensor 34 detects that conductive layer 102 is at a positive potential, the control circuit 32 would cause discharge corona unit 30 to deposit negative charge on the surface of photoconductive layer 104, and if sensor 34 detects a negative voltage on conductive layer 102, control unit 32 would cause discharge corona unit 30 to deposit positive charge on the surface of photoconductive layer 104.

When the sensor 34 is of the non-contacting type as illustrated in FIG. 1, it is preferred that the sensor be located just prior to the charging corona unit 22 as illustrated in FIG. 1. Since the sensor 34 is very close to the charging corona unit 22, it can provide a relatively quick response to the buildup of a surplus charge provided by that unit.

Although not illustrated in FIG. 1, conventional electrophotographic recording systems generally include a fusing step which fixes the recorded image. It is preferred to locate the discharging corona unit 30 after the developing stage 26 but before the fusing stage. One advantage of locating the discharge corona element 30 before the fusing stage is that humidity sensitive conductive layers which become electrically non-conductive during fusing can be used.

Although the sensor 34 has been illustrated and described as one that does not make direct contact to the conductive layer 102, this invention can be beneficially employed with a sensor that is directly connected to the conductive layer 102. Thus, there is shown in FIG. 3 an electrical contact 106 to conductive layer 102. The contact 106 is connected to ground through a resistor 108 and is also connected to the input 40 of the control circuit. It should be noted that although resistor 108 has been illustrated in FIG. 3, resistor 108 can be considered a part of control circuit 32. Thus, there is developed across resistor 108 a voltage that is proportional to the potential of conductive layer 102. One embodiment of this invention has been constructed in which resistor 108 is 1,000,000 ohms and in another embodiment resistor 108 is 1,000,000,000 ohms. The advantages of directly contacting the conductive layer 102 in order to measure the potential of the conductive layer 102 will now be stated. In the prior art recording systems in which the conductive layer 102 is connected directly to ground in order to maintain the conductive layer 102 at ground potential, relatively large currents can flow through the contact which may damage the contact. Due to the very large value of resistor 108 and the high input impedance presented by amplifier 52, the current through the contact 106 is greatly reduced which decreases the likelihood that the contact will be damaged. The fact that corona element 30 is controlled to further reduce the potential of the conductive layer 102 also results in further reduction of the current flowing through contact 106.

It is also clear that the sensor 34 could be a device that directly measures the net charge on the surface of photoconductive layer 104 of film 10.

Since the control circuit 32 automatically causes discharge corona unit 30 to maintain the potential of conductive layer 102 very close to ground, there is no potential buildup on conductive layer 102 due to the effect of changing environmental conditions on the discharge characteristic of corona units 22 and 30 or due to a varying charge distribution caused by recording different images over the entire length of the film 10 or due to the application of charged toner particles to the photoconductive layer 104 of the film 10.

While the present invention has been described with reference to a specific embodiment thereof, it will be obvious to those skilled in the art that various changes and modifications may be made without departing from the invention in its broader aspects. For example, although the invention has been described as an apparatus for recording on electrophotographic film, it will be apparent to those skilled in the art that this invention can be utilized in a system for recording on an electrographic medium since such a medium has a conductive layer and an insulative charge retaining layer.

What is claimed is new and desired to be secured by Letters Patent of the United States is:

1. An apparatus for recording on an electrographic medium, said medium comprising an insulative charge retaining layer and a conductive layer, said apparatus comprising:

(a) means for providing a distribution of charge of one polarity on a surface of the medium, said distribution of charge representing a desired image to be recorded on the medium;

(b) sensing means, coupled to the conductive layer, for generating a signal representing the potential of the conductive layer; and (c) discharge corona means responsive to the sensing means signal, for depositing charge having a polarity opposite of said one polarity on the surface of the charge retaining layer, the level of charge deposited by the discharge corona means being automatically controlled by the sensing means signal so as to maintain the conductive layer at a constant potential.

2. An apparatus for recording an electrophotographic medium, said medium comprising an insulative substrate, a conductive layer overlying the substrate and a photoconductive layer overlying the conductive layer, said apparatus comprising:

(a) first charging means for providing a distribution of charge of one polarity on the surface of the photoconductive layer, said distribution of charge representing a desired image to be recorded on the medium;

(b) sensing means, coupled to the conductive layer, for generating a signal representing the potential at the conductive layer; and (c) second charging means responsive to the sensing means signal, for depositing charge having a polarity opposite of said one polarity on the photoconductive surface of the medium, the level of charge deposited by the second charging means being automatically controlled by the magnitude of the sensing means signal so as to maintain the conductive layer at a constant potential.

3. An apparatus as recited in claim 2 additionally comprising a first manually adjustable circuit for generating a signal representing a desired d-c level of charge deposited by the second charging means, said second charging means being additionally responsive to the first circuit signal.

4. An apparatus as recited in claim 2 wherein the first charging means comprises:

(a) corona means for depositing a uniform distribution of charge of said one polarity on the surface of the photoconductive layer; and (b) means for exposing the uniformly charged surface of the photoconductive layer to a light pattern thereby modifying the deposited distribution of charge in accordance with a desired image to be recorded on the medium.

5. An apparatus as recited in claim 4 additionally comprising a first manually adjustable circuit for generating a signal representing a desired level of charge deposited by the second charging means, said second charging means being additionally responsive to the first circuit signal.

6. An apparatus as recited in claim 2 wherein the sensing means includes a high impedance contact to the conductive layer of the medium.

7. An apparatus as recited in claim 2 wherein the sensing means comprises a resistor connected between the conductive layer and a reference potential.

8. An apparatus for recording on an electrophotographic medium, said medium comprising an insulative substrate, a conductive layer overlying the substrate and a photoconductive layer overlying the conductive layer, said apparatus comprising:

(a) means for providing a desired charge distribution on the surface of the photoconductive layer representing a desired image to be recorded;

(b) sensing means, coupled to the conductive layer, for generating a signal representing the magnitude and polarity of the potential at the conductive layer; and (c) discharge corona means responsive to the sensing means signal for depositing charge on the developed photoconductive surface, the polarity and magnitude of the discharge corona current being automatically controlled by the magnitude and polarity of the sensing means signal so as to maintain the conductive layer at a constant potential.

* * * * *